US008082638B2

(12) United States Patent
Muenstermann

(10) Patent No.: US 8,082,638 B2
(45) Date of Patent: Dec. 27, 2011

(54) APPARATUS FOR PRODUCING TEXTILES, NONWOVEN SUBSTANCES, SPUNBOND FABRICS, PAPER MATERIALS, AND/OR PERFORATED FILMS

(75) Inventor: Ullrich Muenstermann, Egelsbach (DE)

(73) Assignee: Fleissner GmbH, Egelsbach (DE)

( * ) Notice: Subject to any disclaimer, the term of this patent is extended or adjusted under 35 U.S.C. 154(b) by 457 days.

(21) Appl. No.: 12/307,996

(22) PCT Filed: Jul. 7, 2007

(86) PCT No.: PCT/EP2007/006030

§ 371 (c)(1),
(2), (4) Date: Jan. 8, 2009

(87) PCT Pub. No.: WO2008/006522

PCT Pub. Date: Jan. 17, 2008

(65) Prior Publication Data

US 2009/0188090 A1 Jul. 30, 2009

(30) Foreign Application Priority Data

Jul. 14, 2006 (DE) ..... 10 2006 033 071

(51) Int. Cl.
*D04H 1/46* (2006.01)

(52) U.S. Cl. ..... 28/104; 28/106

(58) Field of Classification Search ..... 28/104, 28/105, 106, 167, 163; 492/28, 30, 31, 33–37; 162/296, 297, 309, 310, 357; 442/408
See application file for complete search history.

(56) References Cited

U.S. PATENT DOCUMENTS 3,034,180 A * 5/1962 Greiner et al. ..... 19/301
(Continued)

FOREIGN PATENT DOCUMENTS

DE 102005036759 8/2005
(Continued)

*Primary Examiner* — Amy Vanatta
(74) *Attorney, Agent, or Firm* — Andrew Wilford

(57) ABSTRACT

The invention relates to an apparatus for producing textiles, nonwoven substances, spun-bonded fabrics or paper materials (5) with the aid of at least one screen drum (1) having openings (4) for transporting away the fluid (6) which is output from a water bar (7) and having numerous outwardly directed elevations (3) which are situated on the outside of the screen drum (1) for the perforation of the nonwoven (5). The invention is based on the object of providing an apparatus which makes it possible, during the water conversion and at the same time as the perforation, also to make patterns in the nonwoven without influencing the strengthening substantially in the process. The object has been achieved in that one or a plurality of regions (8) on the outer side of the screen drum (1) does/do not have any elevations (3) but only openings (4).

20 Claims, 3 Drawing Sheets

U.S. PATENT DOCUMENTS

| | | | | | |
|---|---|---|---|---|---|
| 3,679,535 | A | * | 7/1972 | Kalwaites | 428/131 |
| 3,681,182 | A | * | 8/1972 | Kalwaites | 428/131 |
| 3,750,237 | A | * | 8/1973 | Kalwaites | 28/105 |
| 3,769,659 | A | * | 11/1973 | Kalwaites | 28/104 |
| 3,787,932 | A | * | 1/1974 | Kalwaites | 28/105 |
| 4,868,958 | A | | 9/1989 | Suzuki | 28/104 |
| 5,098,764 | A | * | 3/1992 | Drelich | 428/131 |
| 5,115,544 | A | | 5/1992 | Widen | 28/105 |
| 5,274,893 | A | | 1/1994 | Kitamura | 28/105 |
| 5,822,833 | A | * | 10/1998 | James et al. | 28/105 |
| 5,895,623 | A | * | 4/1999 | Trokhan et al. | 264/504 |
| 6,324,738 | B1 | | 12/2001 | Fleissner | 28/104 |
| 6,338,187 | B1 | * | 1/2002 | Fleissner | 28/106 |
| 6,725,512 | B2 | * | 4/2004 | Carter | 28/104 |
| 7,082,654 | B2 | * | 8/2006 | Snider et al. | 28/104 |
| 7,421,766 | B2 | * | 9/2008 | Munstermann | 28/167 |
| 2002/0004348 | A1 | * | 1/2002 | Kelly et al. | 442/327 |

FOREIGN PATENT DOCUMENTS

| | | |
|---|---|---|
| EP | 1588828 | 2/2003 |

* cited by examiner

APPARATUS FOR PRODUCING TEXTILES, NONWOVEN SUBSTANCES, SPUNBOND FABRICS, PAPER MATERIALS, AND/OR PERFORATED FILMS

CROSS REFERENCE TO RELATED APPLICATIONS

This application is the US national phase of PCT application PCT/EP2007/006030, filed 7 Jul. 2007, published 17 Jan. 2008 as WO2008/006522, and claiming the priority of German patent application 1020060330714 itself filed 14 Jul. 2006, whose entire disclosures are herewith incorporated by reference.

FIELD OF THE INVENTION

The invention relates to an apparatus for producing textiles, nonwovens, spunbond textiles, paper materials and/or perforated films, having at least one foraminous drum formed with holes for transporting away the fluid discharged from a water bar, and having numerous outwardly directed bumps on the outside of the foraminous drum for perforating the nonwovens, one or more regions on the outside of the foraminous drum not having any bumps, but only holes.

BACKGROUND OF THE INVENTION

An apparatus for producing perforated nonwovens by means of hydrodynamic needle punching is known from EP 1 001 064 [U.S. Pat. No. 6,324,738], the perforations being formed as substantially sharply defined pores of any dimension in the nonwoven. This apparatus is comprised of a smooth continuous surface carrying and transporting the nonwoven, having drainage holes for transporting away the sprayed on fluid by means of a water bar having multiple discharge nozzles at high pressure, and further having three-dimensional bumps raised from the plane of the smooth surface for producing the perforations in the nonwoven. For this purpose the bumps are nonuniformly distributed across the continuous surface, so they fall at random on the surface of the nonwoven. However, such a system cannot be utilized for embossing patterns, such as animal or plant images, or other geometrically defined shapes in the nonwoven.

U.S. Pat. No. 5,115,544 only shows a method whereby the patterns are pressed into the nonwoven by means of bumps. The bumps, however, are not intended to form the imprint in the nonwoven in the object according to the application, but instead merely surround the pattern to be formed on the foraminous drum.

Furthermore, a method for producing a nonwoven substance is known (DE69224769) [U.S. Pat. No. 5,274,893], where a carrier web (5) is utilized, on whose pattern side a plurality of projections (6, 6') are provided. The projections (6, 6') are of large and small sizes. They are made of thermoplastic resin, and are welded onto the pattern side of the web. A quantity of fiber (2) is deposited onto this web (5), which has irregular patterns formed by the projections (6, 6'). Water or hot air is applied under high pressure to the layer of fibers in order to compress them and to felt the fibers. Subsequently, the fibers (2) are pressed onto the projections in order to form patterns in the nonwoven in this manner.

OBJECT OF THE INVENTION

The object of the invention is to provide an apparatus that enables the application patterns simultaneously with the perforation during water needle punching, such as animal or plant images, or other geometrically defined shapes into the nonwoven, without having an adverse effect on the consolidation process. Furthermore, a closed area is formed in the nonwoven, having ventilation holes instead of holes that are distributed across the entire surface of the nonwoven. In the latter case the stability or rigidity of a nonwoven is not obtained to the desired degree. The stability or rigidity of a nonwoven can be substantially improved by means of an advantageous distribution of the nonwoven surface into areas with and without ventilation holes, wherein the patterns are formed particularly by ventilation holes.

SUMMARY OF THE INVENTION

The object is attained in that the areas having the bumps, which serve for forming a surface pattern in the nonwoven, such as animals, plants, or geometric shapes, are appropriately arranged or grouped on the foraminous drum jacket, and surround, or delimit the surface pattern to be formed on the outside of the foraminous drum.

The advantage of this apparatus is particularly that not only are the patterns formed by means of targeted perforation by bumps, or pins, but also that the patterns are created in locations in the nonwoven at which only drainage holes, and no bumps or pins are present. The areas having bumps or pins, cover a preponderant part of the foraminous drum surface. In this manner the largest part of the surface of the nonwoven is uniformly stabilized by the perforations formed in the nonwoven by means of the bumps or pins, which are randomly arranged within their respective surfaces. According to this illustrated embodiment the surfaces embodied as a pattern are perforated. It is also possible with the embodiment of the foraminous drum surface that the surfaces appearing as a pattern in the nonwoven are not perforated. In this manner the plurality of patterns can be created in the nonwoven in a simple manner.

It is further advantageous that the bumps on the outside of the foraminous drum are at least partially distributed unevenly, or are arranged at a different spacing and/or at a uniform spacing from each other.

In an advantageous embodiment holes for the passage of a fluid being discharged from the water bar are provided at least in those areas, in which bumps are provided and/or in those areas, in which no bumps are provided.

It is further advantageous that the bumps have the form of pins on the outside of the foraminous drum. In this manner, for example, straight lines, wavy structures, or grid shapes can be created, wherein the pins can be pulled out from the nonwoven without any problems after the formation of the patterns.

In a further embodiment according to the invention it is of advantage that the bumps are embodied such that they are conically tapered toward the outside, or end in a peak, or are shaped in the manner of a cylinder.

It is also advantageous that the bumps have a circular, oval, or polygonal or square or elongated cross-section.

For this purpose it is of advantage that the bumps are arranged in the area of a foraminous drum jacket having bumps at a spacing of between 1.5 mm and 20 mm, preferably 3 mm to 10 mm.

Furthermore, it is of advantage that the bumps cover an area of the foraminous drum jacket of between 20% and 50%, preferably between 25% and 30%.

It is further advantageous that the areas without bumps take up an overall surface of 1% to 50%, preferably between 20% and 50%, or between 25% and 30% of the total surface of the foraminous drum.

It is also of advantage that those areas having bumps, and are utilized for forming surface patterns in the nonwoven, such as animals, plants, or geometric shapes, are arranged in an appropriate array or grouping or grouping on the foraminous drum jacket. In this embodiment according to the invention the patterns in the nonwoven are created by areas in the nonwoven that are not perforated by the bumps on the foraminous drum jacket. It is further advantageous that those areas having no bumps, and those areas having bumps for forming surface patterns, such as animals, plants, or geometric shapes, are arranged in the requisite array or grouping. Those areas having bumps or pins, cover a large part of the foraminous drum surface, bring about the desired stability of the nonwoven substance, and simultaneously contribute to the surface patterning of the nonwoven substance.

It is also advantageous that the patterns created in the nonwoven are positioned at least partially, or preponderantly in the plane of the nonwoven, and that the nonwoven has an at least approximately equal thickness, wherein the perforations incorporated in the nonwoven are distributed such that they produce one or multiple equally or differently formed surface patterns in the nonwoven. In a further embodiment of the invention it is of advantage that those areas of the foraminous drum jacket having no bumps, and those areas having bumps each form a defined surface.

It is further of advantage that the areas of the foraminous drum jacket having no bumps are connected to each other, or surround or contain those areas having bumps.

It is further of particular advantage that the holes in the foraminous drum jacket are distributed across the entire surface of the foraminous drum jacket in a uniform and/or uneven manner, and have a diameter of between 0.1 mm and 3 mm, preferably of between 1 mm and 1.5 mm.

Thus the areas having bumps or pins, cover a preponderant part of the foraminous drum surface, bring about the desired stabilization of the nonwovens in the nonwoven, and also simultaneously contribute to the surface patterning of the nonwoven substance.

SPECIFIC DESCRIPTION

Figure 1:
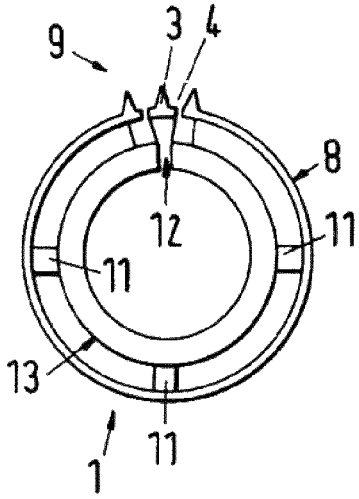
FIG. 1 is a detail view of the surface of a foraminous drum jacket with and without bumps or pins.

FIG. 1 shows a foraminous drum 1 having a jacket 2 of plastic or metal supported on a cylindrical more rigidly constructed tube 13 by means of support elements 11. The foraminous drum jacket 2 thus forms the surface of the foraminous drum 1. The foraminous drum jacket 2 has holes, drainage holes, or micro-pores 4, which serve for transporting away the sprayed water of a water jet 6 coming from the water bar 7. The pipe 13 simultaneously serves as a suction pipe in order to suction off the water sprayed onto the foraminous drum jacket 2, and thus onto the nonwoven. The transporting away of the water is then carried out via an intake hole 12 incorporated in the pipe 13, on which a low pressure is applied.

Figure 2:
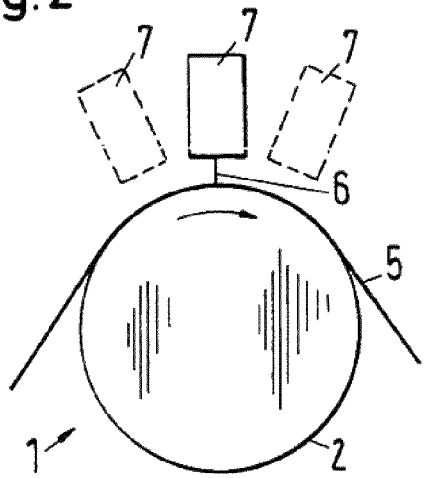
FIG. 2 is a schematic view of a foraminous drum having one or multiple dashed-line water bars for directing jets onto nonwovens.

According to FIG. 2 two or more water bars 7 may also be arranged in a second illustrated embodiment in the area of the foraminous drum 1. For this purpose a pipe 13 not illustrated in the drawing is correspondingly equipped with two or more intake holes 12.

Figure 4:
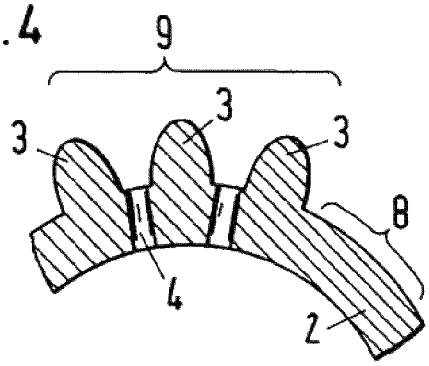
FIG. 4 is a partial cross-section of the foraminous drum according to FIG. 1 having the bumps or pins and an area without bumps.

As is obvious particularly from FIGS. 1 and 4, the foraminous drum jacket 2 has numerous outwardly directed bumps 3, which serve for the perforation of the nonwoven 5. These bumps or pins 3 leave small pores or perforations 14 in the nonwoven 5, which are substantially sharply defined, and which are pressed into an already hardened, or partially hardened nonwoven substance 5 for this purpose. The perforations 14 in the nonwoven correspond approximately to the cross-section of the pins 3.

The surface of the foraminous drum jacket 2 has areas 9 in which the bumps 3 in the form of pins are arranged closely next to each other. The areas 9 having the pins 2 represent closed or firmly defined areas. The spacing of the bumps or pins 3 to each other is uneven. A stability that is uniform across the surface is achieved in the nonwoven without any interference strips by means of the random arrangement of the bumps or pins 3.

Figure 3:
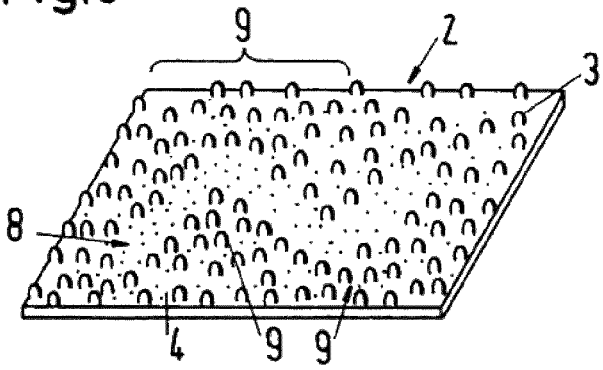
FIG. 3 is a portion of the surface of the foraminous drum jacket having bumps or pins and areas having no bumps.

The bumps 3 on the outside of the foraminous drum 1, or on the foraminous drum jacket 2, are arranged in an unevenly distributed manner in the embodiment illustrated in FIG. 3. However, the bumps may also be arranged at a uniform spacing from each other according to an embodiment not illustrated in the drawing.

The bumps 3 are conically tapered toward the outside, or end in a peak, or are shaped in the manner of a cylinder. The bumps 3 may have a circular, oval, or polygonal or square or elongated cross-section.

The cross-sectional shape of the bumps or pins 3, may also have the contour of an involute.

The bumps 3 from the area 9 of the foraminous drum jacket 2 are arranged at a spacing of between 1.5 and 20 mm, preferably 3 to 10 mm. Further, the bumps 3 may cover an area 9 of the foraminous drum jacket 2 of between 20% and 50%, preferably between 25% and 30% of the surface.

Figure 5A:
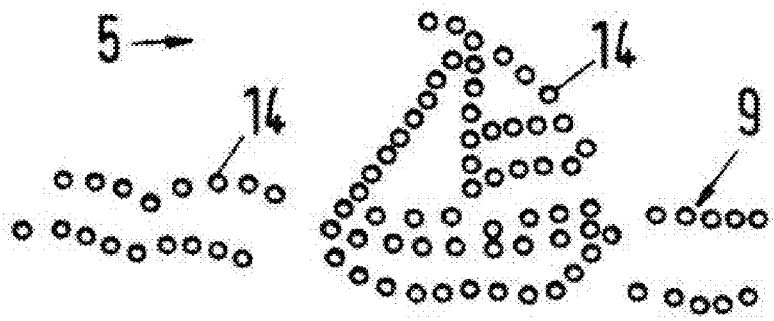
FIG. 5*a* to *d* are various examples of patterns formed in the nonwoven by means of perforation, or by means of clear regions, where according to FIG. 5*b* the perforations delimit the area forming the pattern.
Figure 5B:
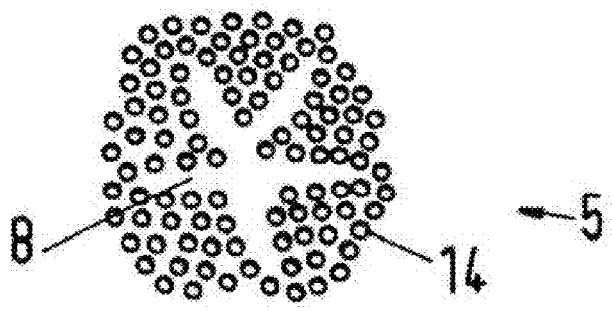
Figure 5C:
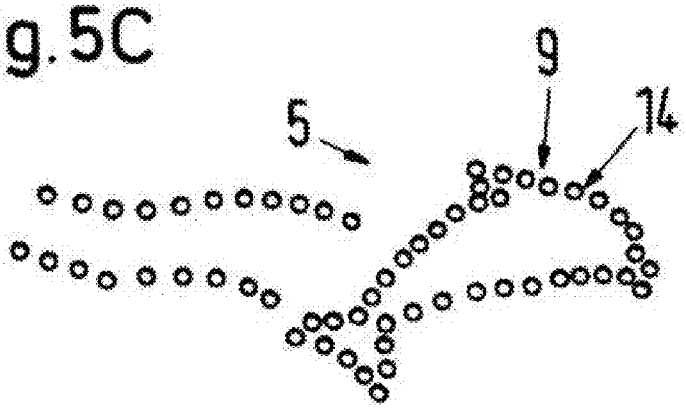
Figure 5D:
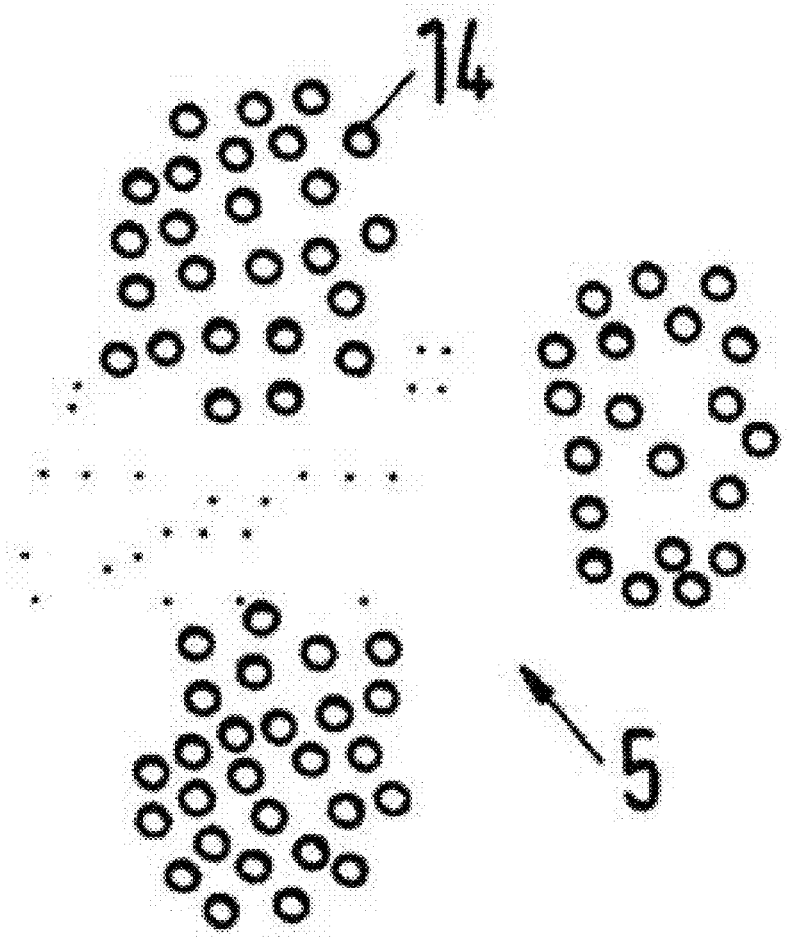

According to FIGS. 5*a* and 5*c*, the areas 9 having the bumps 3 in one illustrated embodiment may be utilized in order to form a surface pattern, such as animals, plants, or geometric shapes in the nonwoven 5. For this purpose, a pattern is created by means of perforation of the nonwoven 5, which is raised from the remaining, non-perforated surface of the nonwoven corresponding to the areas 8.

The areas 8 on the surface of the foraminous drum jacket 2 in which no bumps or pins 3 are provided, and also illustrated in FIG. 3 and FIG. 4, are also of particular significance. These areas 8 of the foraminous drum jacket 2 are merely provided with the drainage holes, holes, or micro-pores 4. The areas 8 without bumps 3 take up an overall surface of 1% to 50%, preferably between 20% and 50%, or between 25% and 30% of the total surface of the foraminous drum jacket 2 of the foraminous drum 1.

The areas 8 without bumps or pins 3 on the surface of the foraminous drum jacket 2 bring about a surface change in the nonwoven 5 during the water needle punching of the nonwoven substance 5 as compared to the perforated surfaces in the nonwoven 5 surrounding the same. For this purpose the areas 8 having no bumps 3 serve for forming a surface pattern, such as animals, plants, or geometric shapes, wherein the areas 8 are surrounded by an appropriate respective array or grouping of pins 3. The areas 8 on the surface of the foraminous drum jacket 2 may be arranged in an isolated manner from each other, or may be connected to each other, thus also creating superordinate patterns in the nonwoven 5.

The invention claimed is:

1. A device for producing a textile, spunbond, or paper nonwoven by means of at least one drum having holes for carrying off a fluid discharged from a water bar, and having multiplicity of outwardly directed bumps on an outside surface of the drum for perforating the nonwoven, one or more regions on the outside surface of the drum having no bumps but merely holes instead, the regions having bumps serving for forming a surface pattern in the nonwoven being arranged in an array or grouping on the outer surface of the drum that surrounds or delimits a surface pattern to be formed, the bumps being dimensioned to leave the nonwoven with small sharply defined pores or perforations.

2. The device according to claim 1 wherein the bumps are nonuniformly distributed on the outside of the drum at least partially, or are arranged at different spacings from each other.

3. The device according to claim 1 wherein holes at least for the passage of fluid discharged from the water bar are provided on the outside of the drum.

4. The device according to claim 1 wherein the bumps on the outside of the drum are shaped as pins.

5. The device according to claim 1 wherein the bumps are formed conically outwardly tapered or end in a point, or are shaped as cylinders.

6. The device according to claim 1 wherein the bumps have a circular, oval, polygonal, square, or elongated cross-section.

7. The device according to claim 1 wherein the bumps are in a region of a drum jacket having bumps at a spacing of between 1.5 mm and 20 mm.

8. The device according to claim 1 wherein the bumps cover a region occupying of between 20% and 50% of the drum jacket.

9. The device according to claim 1 wherein the regions having no bumps take up an overall surface of 1% to 50% of the total surface of the drum jacket.

10. The device according to claim 1 wherein the regions having bumps, and being utilized for forming surface patterns in the nonwoven are arranged on the drum jacket in arrays or groupings.

11. The device according to claim 1 wherein the regions having no bumps, and the regions having bumps for forming surface patterns are arranged in appropriate arrays or groupings.

12. The device according to claim 1 wherein the patterns created in the nonwoven are situated at least partially, or preponderantly in a plane of the nonwoven, and that the nonwoven has an at least approximately equal thickness, the perforations incorporated in the nonwoven being distributed such that they produce one or more equally or differently shaped surface patterns in the nonwoven.

13. The device according to claim 1 wherein the regions of the drum jacket having no bumps, and the regions having bumps each form a defined surface.

14. The device according to claim 1 wherein the regions of the drum jacket having no bumps are connected to each other, or surround, or contain the regions having bumps.

15. The device according to claim 1 wherein the holes in the drum jacket are uniformly and/or nonuniformly distributed across the entire surface of the drum jacket, and have a diameter of between 0.1 mm and 3 mm.

16. An apparatus for making a patterned nonwoven, the apparatus comprising:

a pattern drum having an outer surface formed with an array of outwardly projecting bumps formed cylindrically, tapering outwardly, or pointed and delimiting an area on the surface of a shape corresponding to a desired pattern to be formed, the bumps being dimensioned to leave the nonwoven with small sharply defined pores or perforations;

means for passing a nonwoven web in a travel direction over the drum with one face of the nonwoven web in contact with an outer surface of the drum;

means for directing liquid jets at an opposite face of the web engaged with the drum and thereby pressing the web against the drum, consolidating the web, and pressing the bumps into the one face of the web, whereby a region on the one face into which the bumps are not pressed take the pattern; and means for aspirating liquid from the jets through the drum.

17. The patterning apparatus defined in claim 16 wherein the drum is substantially cylindrical and rotatable about an axis adjacent the means for directing jets.

18. The patterning apparatus defined in claim 16 wherein the bumps are formed as pins projecting outward from the drum.

19. The patterning apparatus defined in claim 16 wherein the bumps are nonuniformly distributed in the array.

20. The patterning apparatus defined in claim 16 wherein the delimited area on the drum surface corresponding to the desired pattern is smooth and devoid of outwardly projecting surface formations.

* * * * *